US005170735A

United States Patent [19]

Kobayashi

[11] Patent Number: 5,170,735

[45] Date of Patent: Dec. 15, 1992

[54] HULL FOR SMALL BOAT

[75] Inventor: Noboru Kobayashi, Kosai, Japan

[73] Assignee: Yamaha Hatsudoki Kabushiki Kaisha, Iwata, Japan

[21] Appl. No.: 816,848

[22] Filed: Jan. 2, 1992

Related U.S. Application Data

[63] Continuation of Ser. No. 610,463, Nov. 6, 1990, which is a continuation of Ser. No. 145,678, Jan. 14, 1986, which is a continuation of Ser. No. 933,624, Nov. 21, 1986.

[30] Foreign Application Priority Data

Nov. 21, 1985 [JP] Japan ..... 60-261833
Nov. 21, 1985 [JP] Japan ..... 60-261834
Nov. 21, 1985 [JP] Japan ..... 60-261836

[51] Int. Cl.[5] ..... B63B 1/00
[52] U.S. Cl. ..... 114/56; 114/270
[58] Field of Search ..... 114/270, 290, 56, 62, 114/271; 440/38; D12/307-314

[56] References Cited

U.S. PATENT DOCUMENTS

| | | | |
|---|---|---|---|
| D. 226,036 | 1/1973 | Jacobson | D12/307 |
| D. 241,328 | 9/1976 | Naito | D12/314 |
| D. 286,629 | 11/1986 | Suzuki et al. | D12/307 |
| 3,195,496 | 7/1965 | Skuce | 114/271 |
| 3,826,220 | 7/1974 | Jacobson | 114/270 |
| 4,023,353 | 5/1977 | Hall | 440/38 |
| 4,619,215 | 10/1986 | Wood et al. | 114/56 |

*Primary Examiner*—Edwin L. Swinehart
*Attorney, Agent, or Firm*—Ernest A. Beutler

[57] ABSTRACT

A small watercraft of the type designed to be ridden by a single rider and powered by a jet propulsion unit. The hull is designed so as to assist stability in the straight ahead running condition and also to permit a wide variety of turning conditions including spin and edging turns. The rider may achieve the different types of turns depending on whether he shifts his weight forwardly or rearwardly and the hull is designed so as to provide good stability under all of these conditions.

3 Claims, 6 Drawing Sheets

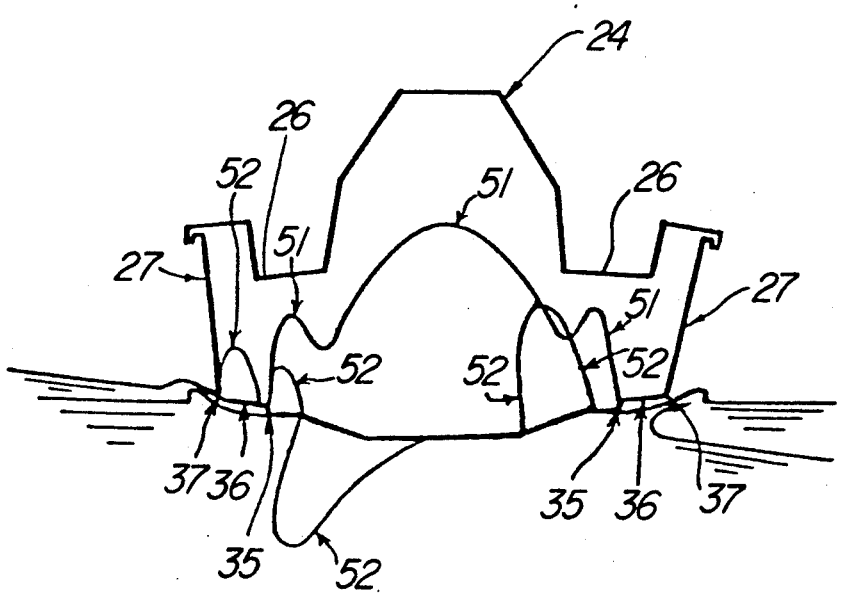
Fig-6
Fig-8
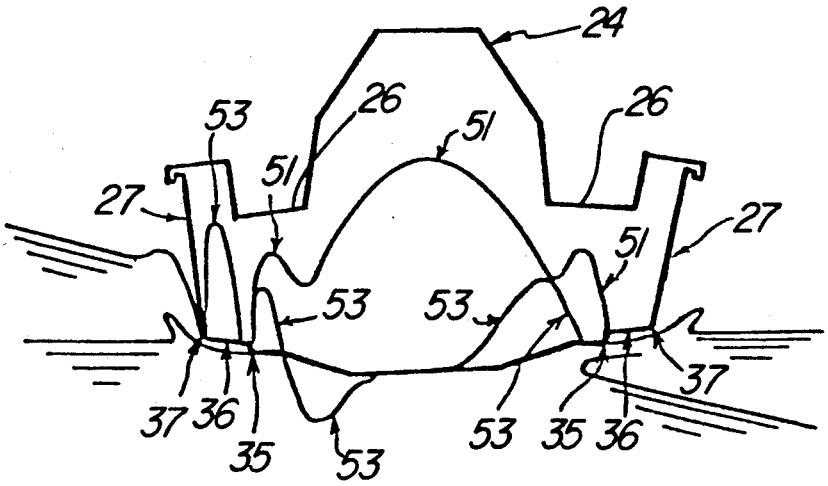

HULL FOR SMALL BOAT

This is a continuation of U.S. patent application Ser. No. 610,463, filed Nov. 6, 1990, which is a continuation Ser. No. 145,678, filed Jan. 14, 1986, which is a continuation of Ser. No. 933,624, filed Nov. 21, 1986.

BACKGROUND OF THE INVENTION

This invention relates to a hull construction for a small boat and more particularly to an improved hull construction for a small watercraft which increases both the maneuverability and the stability of the watercraft under a wide variety of conditions.

There is a class of small watercraft which is highly popular and which is designed primarily to accommodate a single rider, normally wearing a swimming or wetsuit, due to the sporting nature of this type of watercraft. This type of watercraft is normally propelled by a jet propulsion unit wherein water is drawn in from the body of water in which the watercraft if operating, is accelerated by an engine driven impeller and is discharged through a pivotally supported discharge nozzle. The discharged nozzle is supported for pivotal movement so as to effect steering of the watercraft through pivotal movement of the nozzle. With this type of steering arrangement, however, the amount of pivotal movement of the steering nozzle is generally quite restricted. Normally, such steering nozzles do not pivot through more than about 30 degrees. Therefore, even though this type of watercraft is designed to be sporting in nature and highly maneuverable, the restricted pivotal movement of the steering nozzle has tended to cause this type of vehicle to have a relatively large steering radius.

It is, therefore, a principal object of this invention to provide an improved small watercraft having greater maneuverability.

It is another object of the invention to provide a small watercraft that may be steered through very small steering radii.

It is another object of this invention to provide a hull design for a small watercraft wherein spin turns (watercraft turns about its own center) may be executed.

The restricted steering movement and large turning circles of conventional small watercraft of this type, as aforedescribed, also tends to make it difficult to dock or beach the watercraft in a desired fashion. It is, therefore, a further object of this invention to provide a hull arrangement for a small watercraft that facilitates docking and/or beaching.

The very compact and small nature of the watercraft of the type herein referred to gives rise to certain defects that defeat their intended purpose. For example, the relatively small size of the hull tends to cause poor directional stability when traveling in a straight line. That is, the configuration of the hull and the small size tends to create directional instability when traveling in a straight line. Although arrangements have been proposed for improving straight ahead stability, these arrangements tend to increase the resistance of the watercraft to straight ahead travel and thus decrease its speed. Furthermore, such devices as have been proposed for conventional small watercraft tend to further restrict the ability of them to maneuver in small areas and turn about small radii circles. Furthermore, the conventional hull constructions tend to cause these small watercraft of the prior art type to be unstable and become capsized very easily.

It is, therefore, a still further object of this invention to provide an improved hull design for small watercraft that improves stability when running in a straight direction.

It is a further object of this invention to provide a stable and yet high speed hull design for straight travel in a small watercraft.

It is a yet further object of this invention to provide a hull design for a small watercraft that improves stability and reduces resistance when traveling straight ahead but which is nevertheless very stable when turning.

It is a still further object of this invention to provide a hull design for a small watercraft that permits high speed and yet which is maneuverable in turning.

In all watercraft, there are generally two rather dissimilar types of turning operations. In one type of turn, it is desirable that the watercraft be capable of turning on a very small radius, or about a point that lies within the confines of the hull. Also, however, it is desirable to permit high speed turns on relatively larger radii. The hull designs heretofore proposed for one purpose have not been particularly adapted to the other.

It is, therefore, a still further object of the invention to provide a hull design for a small watercraft that is stable under a wide variety of turning conditions and which can execute vastly different types of turns with high degrees of efficiency.

Because of the sporting nature of this type of watercraft, it is also desirable if the operator may effect the changes in handling and steering ability of the watercraft by means in addition to the mere steering of the watercraft through turning of its steering wheel, tiller or the like. That is, the sporting nature of the vehicle can be significantly improved if the operator is able to effect its handling through shifting of his weight forwardly or rearwardly or from side to side in addition to turning the steering wheel. This greatly improves the rider's enjoyment of operating this type of vehicle.

It is, therefore, a still further object of this invention to provide an improved hull design for a small boat wherein the rider may maneuver the boat through shifts of his weight in addition to steering inputs.

SUMMARY OF THE INVENTION

A first feature of this invention is adapted to be embodied in a hull for a small watercraft for facilitating turning in a small radius circle. Powering means are supported at the rear of the hull and are pivotal about a generally vertically extending axis for steering movement. The steering movement of the powering means is limited to substantially less than 90 degrees in each direction from its straight ahead position. The hull is configured so that the center of gravity is positioned rearwardly from the longitudinal center of the hull and the shape of the hull is such that the side flow resistance forward of the longitudinal center of the hull is greater than that at the rear of the longitudinal center and is such that turning forces applied by pivotal movement of the powering means for small steering angles effects turning of the boat about its longitudinal center.

Another feature of the invention is also adapted to be embodied in a hull design for a small watercraft. In accordance with this feature of the invention, the hull design facilitates stability under turning and reduces resistance upon straight ahead running. The hull has an underside with a first area that is normally submerged in straight ahead running and which has a pair of longitudinally extending generally straight chines for assisting in running stability. Second and third areas each disposed outwardly of the first area on respective opposite sides thereof are adapted to become submerged in the body of water upon either or both of turning to that side or leaving of the rider to the respective side for improving the stability of the watercraft and for resisting any further rolling of the watercraft once the second or third area has become submerged.

A still further feature of the invention is adapted to be embodied in a hull for a small watercraft wherein the hull is formed with a pair of longitudinally extending chines that extend in a generally straight direction toward the rear portion of the watercraft and which are curved inwardly toward its center at the front of the watercraft. The configuration of the hull and the buoyancy is such that during normal running and with the rider having his balance in one position, that the curved portions of the chines are substantially out of the water for facilitating straight ahead running. The balance and configuration is, however, such that the rider may bring the curved portion of the chines at one side of the watercraft into contact with the water for assisting turning and maintaining stability by shifting his weight.

Yet another feature of the invention is also adapted to be embodied in a hull design for a small watercraft that improves handling under a wide variety of conditions. In accordance with this feature of the invention, the hull is provided at each side thereof with a pair of longitudinally extending chines. Each of these chines extends parallel to each other and in a generally straight direction for a major portion of the length of the watercraft from the rear to the front. Toward the front of the watercraft, the chines curve inwardly toward the center of the watercraft and the longitudinally outermost chines are longer than the innermost chines. In this way, shifting of the operator's weight may bring one or more of the curved portions into contact with the water for changing the radius of curvature about which the watercraft will turn.

BRIEF DESCRIPTION OF THE DRAWINGS

FIG. 6 is a rear cross-sectional view showing the water forces and conditions during a spin turn.

FIG. 8 is a cross-sectional view, in part similar to FIG. 6, showing the condition when traveling in either a straight ahead direction or when executing an edging turn.

DETAILED DESCRIPTION OF THE PREFERRED EMBODIMENT

Figure 1:
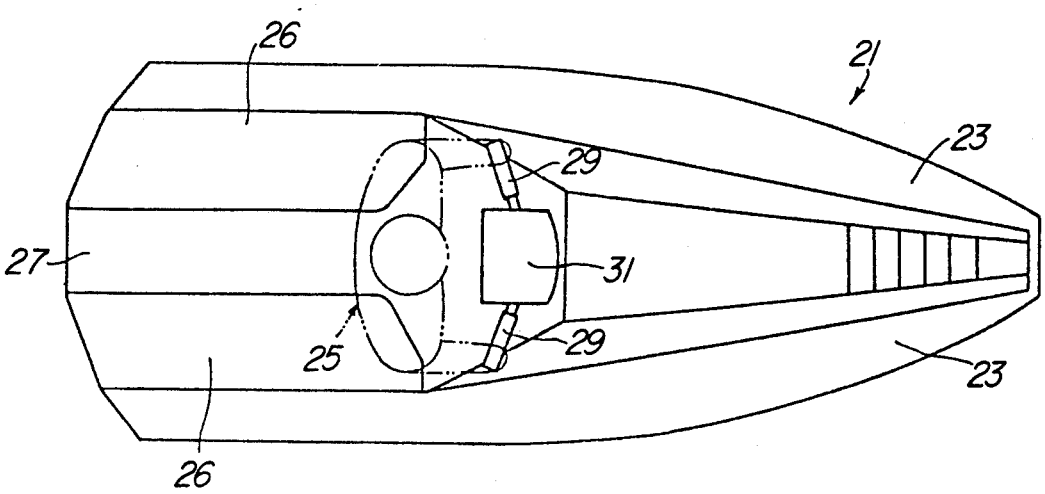
FIG. 1 is a top plan view of a small watercraft constructed in accordance with an embodiment of the invention.
Figure 2:
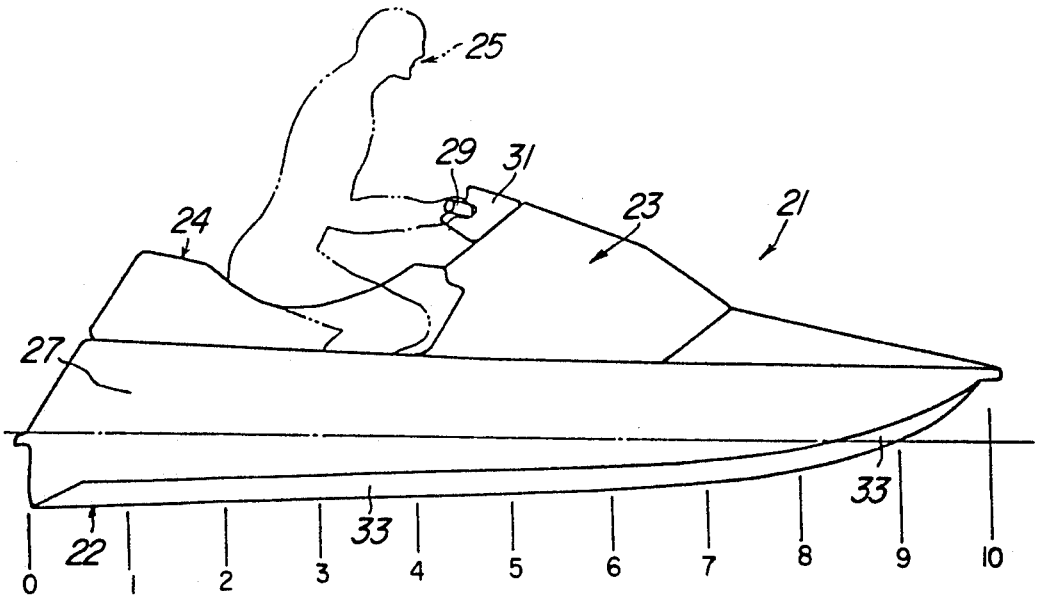
FIG. 2 is a side elevational view of the watercraft.
Figure 3:
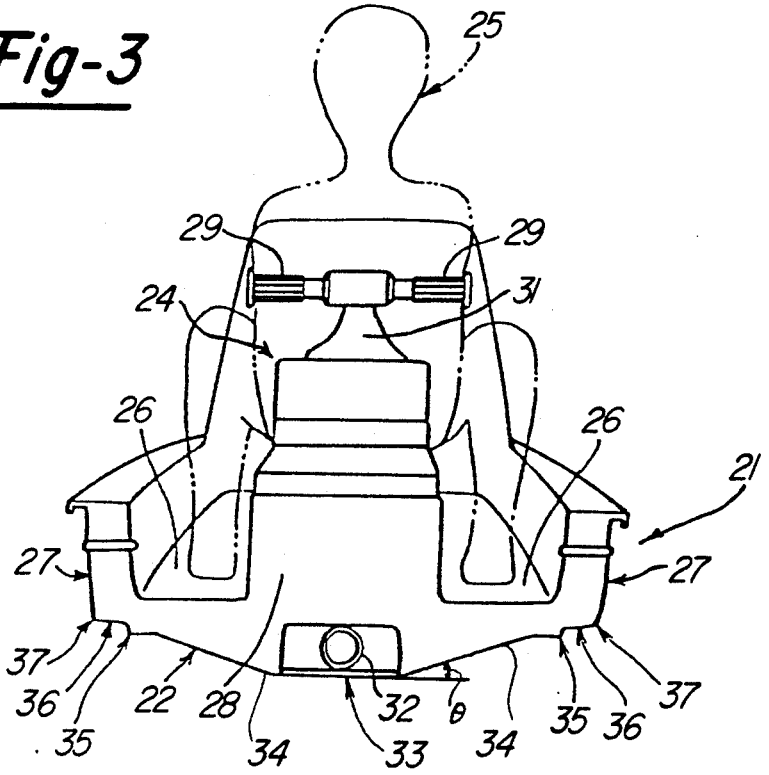
FIG. 3 is an enlarged rear elevational view of the watercraft.

Referring first primarily to FIGS. 1 through 4, a small watercraft constructed in accordance with an embodiment of the invention is identified generally by the reference numeral 21. The small watercraft 21 is comprised of a hull 22 and a deck 23. The hull 22 and deck 23 are affixed to each other in a suitable manner and are formed from a suitable material such as a fiber glass reinforced plastic.

The deck 23 forms a raised seat 24 at the rearward portion of the hull 21 which seat is designed so as to accommodate primarily a single rider, shown in phantom in some of the views and identified generally by the reference numeral 25. The seat 24 is disposed at the rearward end of the watercraft 21 and is bounded by a pair of foot well portions 26 that are defined on opposite sides of the seat at their longitudinal inner portions and by a pair of raised gunnels 27 at their outer portion. It should be noted from FIG. 3 that the foot well portions 26 extend rearwardly and open through a transom 28 formed at the rear of the watercraft. This arrangement permits water to enter the foot wells 26 in the event the vehicle becomes capsized so as to facilitate ease of reentry.

A steering handlebar assembly 29 is supported by a steering support mechanism 31 that is carried by the deck 23 in a suitable manner. The handlebar mechanism 29 is disposed substantially in line with the fore and aft center of gravity of the watercraft 21.

The watercraft 21 is powered by means of a jet drive unit (not shown) that is disposed in the longitudinal center plane of the watercraft 21 in an area positioned beneath and to the rear of the seat 24. This jet drive unit is driven by an internal combustion engine (not shown) in any known manner, which engine is disposed forwardly of the seat 24 and in general alignment with the steering handle 29 so as to locate the center of gravity of the watercraft, as will be described. The water is discharged from the impeller unit of the jet drive unit back to the body of water in which the watercraft 21 is operating through a pivotally supported discharge nozzle 32. The nozzle 32 is steered, in any suitable manner, by means of the handlebar assembly 29 and this steering mechanism may include flexible cables that interconnect the handlebar 29 with the nozzle 32 in a known manner.

In a general sense, the configuration and layout of the watercraft 21 may be considered to be conventional. However, the important features of the invention have to do with the configuration of the underside of the hull and its relationship to the overall balance of the watercraft 21. In this regard, therefore, the layout of the watercraft is important in that the longitudinal center of the watercraft and the center of gravity should be arranged as will be hereinafter described. It is believed that those skilled in the art are well versed on how to arranged such components and reference may be had to my copending application entitled "Component Layout For Small Watercraft", Ser. No. 935,337, filed Nov. 26, 1986 and assigned to the assignee of this application for a description of how the components may be arranged to achieve the desired location of center of gravity.

The hull configuration and how it operates to produce the desired results will now be described by primary reference to FIGS. 3 through 11. The undersurface of the hull 22 includes a centrally positioned, relatively shallow longitudinally extending keel 33 that extends from the bow of the boat and which terminates adjacent to the transom 28. As may best be seen in FIGS. 5, 7 and 9, the keel is narrow at the front of the hull 21 and tapers outwardly until it reaches a point indicated at R in FIG. 5. From this point rearward, the sides of the keel 33 extend generally parallel to each other and they circumscribe an area just slightly wider than that required by the steering movement of the discharge nozzle 32.

On either side of the keel 33, the underside of the hull 22 is provided with generally flat, inclined surfaces 34 that are disposed at a relatively shallow angle to the horizontal. As may be seen from FIG. 3, this angle is identified by the character $\theta$ and is 15 degrees or less.

Figure 5:
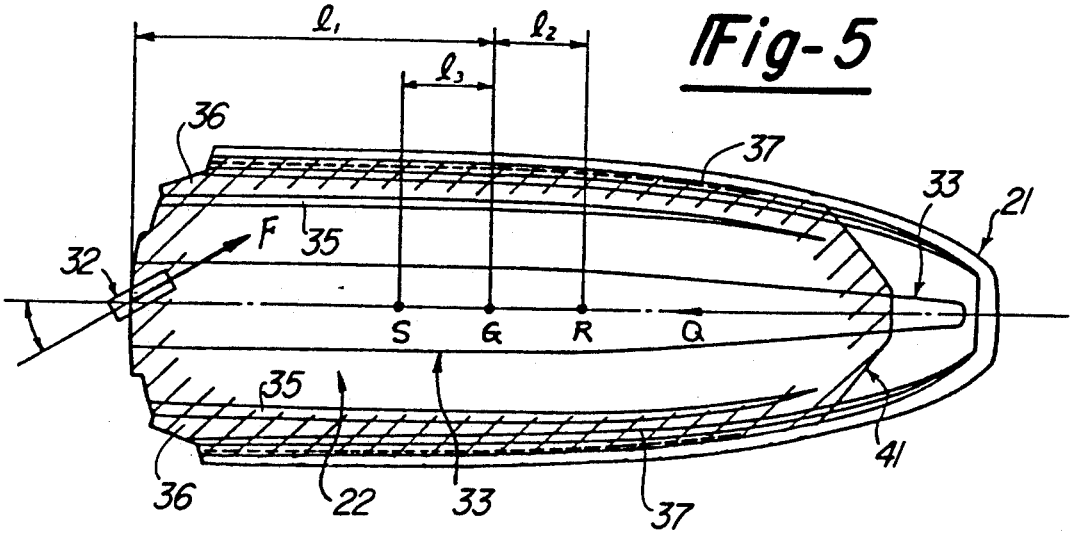
FIG. 5 is a bottom plan view of the hull and shows the water line when the watercraft is executing a spin turn.
Figure 4:
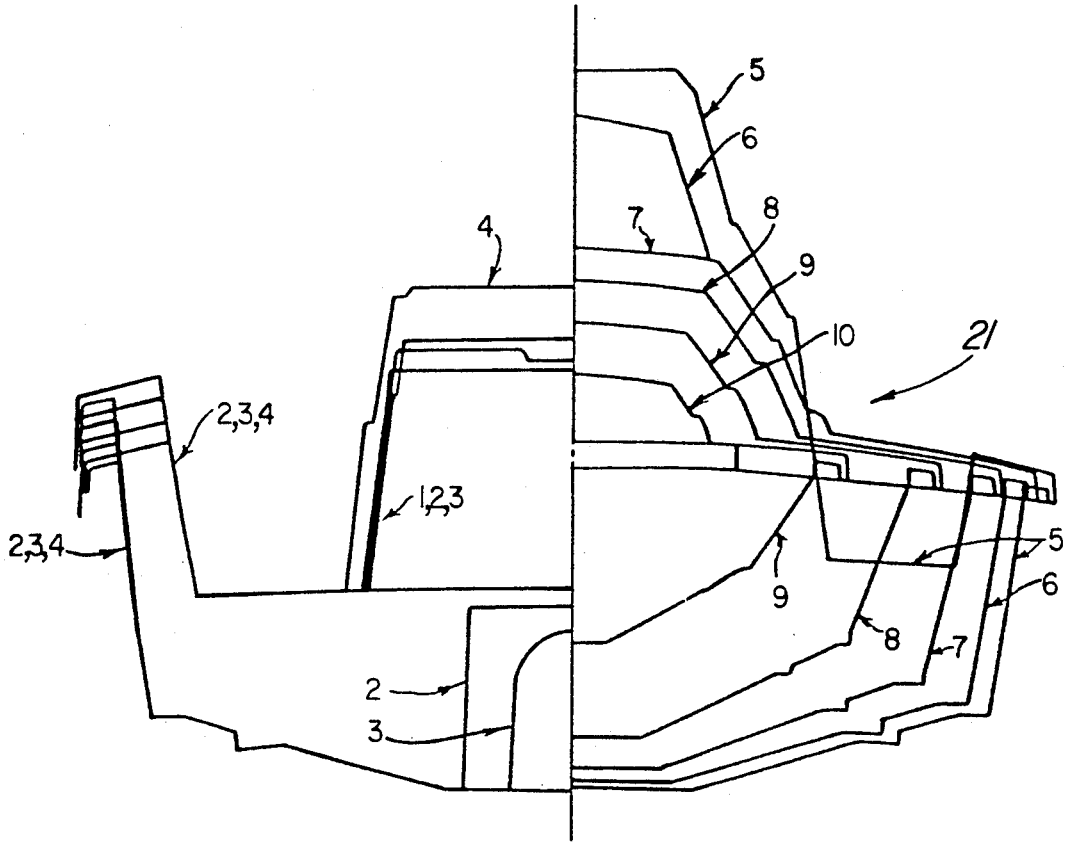
FIG. 4 comprises a plurality of enlarged cross-sectional views taken along the line 0 through 10 of FIG. 2 showing the cross-sectional configuration and shape of the hull and deck of the watercraft.

At a point that coincides approximately with the outer edge of the foot wells 26, the tapered portions 34 terminate in a generally horizontally extending surface that describes a first pair of chines 35. The first chines 35 extend generally parallel and in a longitudinal direction relative to the watercraft to a point well forward of its midpoint and forward of the point R as seen in FIG. 5. Forwardly of this, the chines 35 curve inwardly toward the longitudinal center line of the hull 21 and terminate well short of the bow as shown in FIGS. 5 through 9.

Transversely outwardly of the chines 35, the hull of the watercraft is provided with a raised lower board area 36 which extends generally in a horizontal direction and which extends to the outer periphery of the gunnels 27. The outer periphery of the areas 36 is defined by a pair of outer chines 37 which extend parallel to the chines 35 and also which extend in a longitudinal direction relative to the hull 21 for a substantial portion of its length and forwardly of the point R (FIG. 5). Forwardly, of this point, the outer chines 37 curve in a generally parallel direction to the chines 35, however, the chines 37 extend to the bow of the watercraft.

The configuration of the hull and specifically the underside surface in relation to the center of gravity, weight and buoyancy of the watercraft is such so as to achieve a number of results that provide good stability when traveling at high speeds in a forward direction, which permit turning on a relatively small radius (in fact turning about a center R of the watercraft), and also so as to permit high speed turns to be made or low speed turns to be made with great stability.

FIG. 1 illustrates the contact patch 41 of the hull 22 with the water when the watercraft is in a stationary condition or traveling at low speed. It should be noted that the nozzle 32, as is typical with this type of watercraft, has a relatively narrow steering angle. As seen in FIG. 5, the maximum steering angle $\alpha$ in either direction from the straight ahead position is less than 90 degrees and, in fact, is more like 30 degrees maximum. As a result, normal watercraft of this type tend to turn about a point S in relation to their center of gravity G which tends to cause relatively large turning circles. With this invention, however, the hull shape is such that the watercraft will turn about a point R which is forwardly of the center of gravity G and which, in fact, permits the watercraft to rotate about this point and thus turn through a circle with a zero turning radius. This has great advantage in connection with landing, taking off, or turning in a given spot.

In connection with any watercraft, the forward propulsion force P may be expressed by the following equation:

$$P = F\cos\alpha - Q$$

where:

F = force exerted by the jet propulsion unit, $\alpha$ = the steered angle, and

Q = the resistance to forward motion.

The turning moment of a conventional boat $M_s$ may be expressed by the following equation:

$$M_s = F_1(l_1 - l_3) - G_1 l_2$$

where:

$F_1$ = the force in the direction perpendicular to the axis of turning, and $G_1$ = the side force on the watercraft generated by its hull configuration and which forms a component of the overall forward resistance Q.

Since $F_1 = F\sin\alpha$, the following holds true:

$$M_s = F(l_1 - l_2)\sin\alpha - G_1(l_2 - l_2)\sin\alpha$$

therefore:

$$Ms = k - l_2\sin\alpha$$

where:

k = the turning force.

However, by utilizing the construction as shown, the turning force $M_r$ may be greater than the turning force $M_s$ and the turning force around the axis R with this hull may be described as follows:

$$M_r = F_1(l_1 + l_2) - G_1 l_2$$

solving this for the expression for determining $F_1$, we obtain:

$$M_r = F(l_1 + l_2)\sin\alpha - G_1 l_2$$

this solves to:

$$M_r = Fl_1\sin\alpha - G_1 l_2 + Fl_2\sin$$

and that results in:

$$M_r = k + l_2\sin\alpha.$$

Therefore, it can be understood that with the hull configuration of this invention, the watercraft will be able to turn about itself and at about the point R which is forward of the center of gravity.

Figure 7:
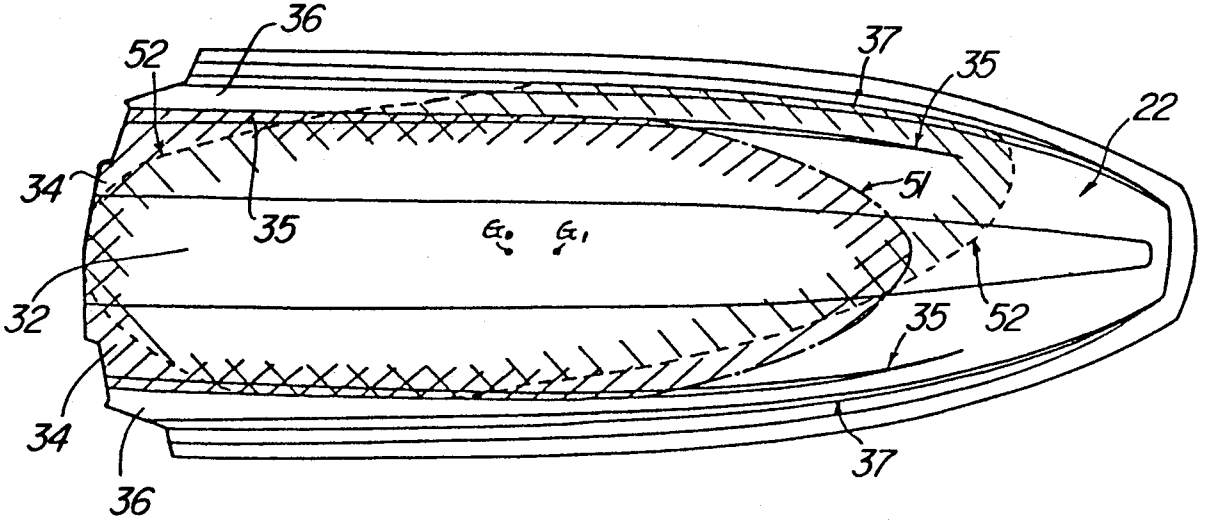
FIG. 7 is a bottom plan view showing the hull configuration and water pressure acting on it when traveling either straight ahead of when executing a spin turn.
Figure 9:
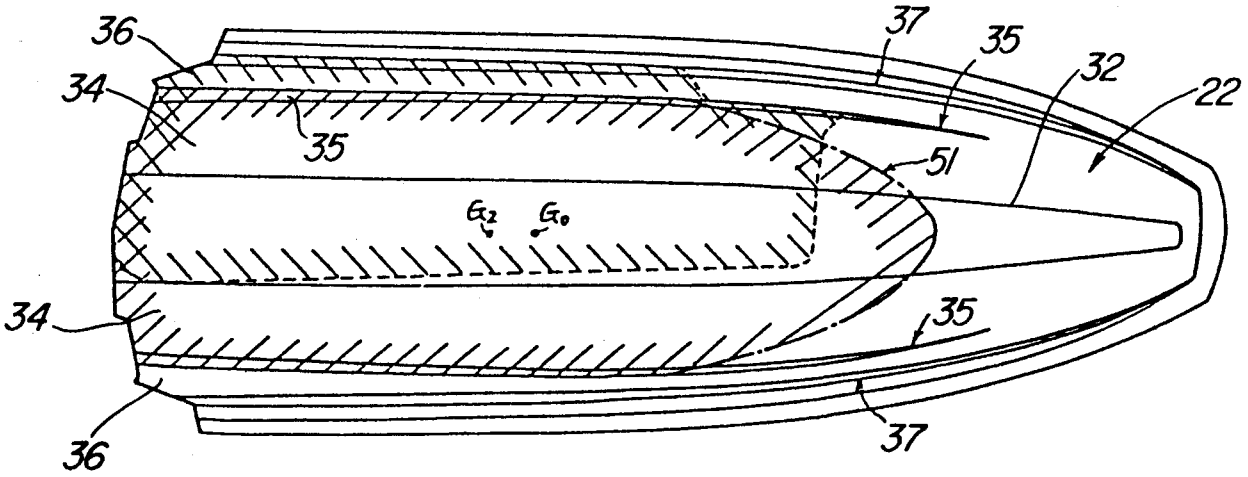
FIG. 9 is a bottom plan view showing the water forces on the hull when traveling in either a straight ahead direction or when executing an edging turn.
Figure 10:
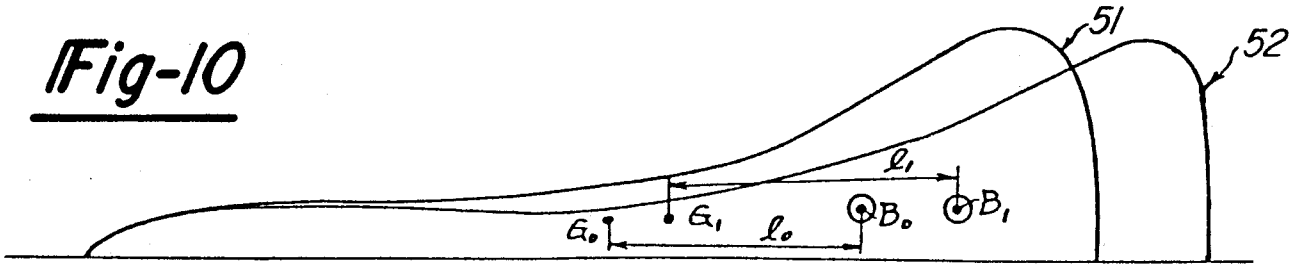
FIG. 10 is a view showing the distribution of forces acting on the watercraft when traveling straight ahead or when executing a spin turn as shown in FIGS. 6 and 7.
Figure 11:
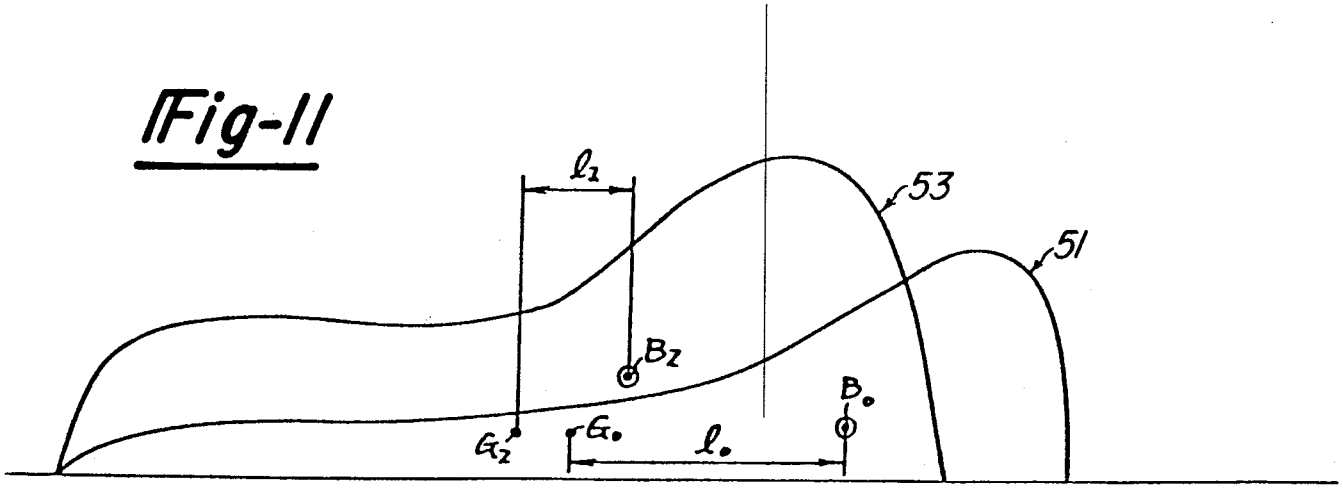
FIG. 11 is a view showing the distribution of the water forces on the hull in a fore and aft direction when traveling in the straight ahead condition or when executing an edging turn, as shown in FIGS. 8 and 9.

The hull configuration also reduces the resistance to forward travel when traveling in a straight line while at the same time maintaining stability under such straight line running. FIGS. 6 through 11 show the condition when running in a straight ahead position wherein the water pressure under this condition acting on the bottom of the watercraft is identified by the curve 51 with FIGS. 6 and 8 showing the side to side and fore and aft distribution, FIGS. 10 and 11 showing the fore to aft buoyancy distribution and FIGS. 7 and 9 showing the distribution in both directions.

It will be noted that when traveling in a straight ahead direction at high speed, the water only contacts the keel 33, inclined areas 34 and chines 35. From FIGS. 7 and 9, it should be readily apparent that this arrangement insures good stability because the chines 35 are in contact with the water only along their longitudinally extending portions and thus they tend to hold the watercraft in a straight line position. Thus, the watercraft has good stability and the area under the recesses 36 is above the water level.

If the rider wishes to execute a spin turn where the watercraft turns or spins rapidly about a small radius of curvature or in place similar to what was previously described, he may, in addition to turning the handlebars 29, lean forward and in the direction in which he wishes to turn. When this occurs, the water level will exert a pressure along an area 52 on the underside of the watercraft so as to improve the turning. The pressure distribution 52 appears in one view of FIG. 6 and also in FIG. 7. In FIG. 7, the new center of gravity achieved by the rider's leaning is identified by the point $G_1$. When this occurs, the chines 37 on the outer periphery of the inside of the turn will bite into the water and provide further stability against additional leaning. In addition, the water pressure will now start acting on the curved portions of the chines 35 and 37 so as to assist in the turning operation and so as to create a hydrodynamic pressure to assist in turning.

Furthermore, the flattened portion of the rear of the hull and specifically the shallow inclination of the portions 35 and the reduced pressure acting in this area, permits the rear end in effect slide around the turn and further accentuates the ability to turn over a small radius.

FIGS. 8, 9 and 11 show the condition when turning from a straight ahead condition into a high speed or edging turn. Under this condition, the rider leans rearwardly on the seat to shift the center of gravity to the point $G_2$. The water pressure acting on the underside of the watercraft the assumes the force line 53 wherein the underside hull area 36 to the rear of the watercraft now contacts the water line and there is a good pressure obtained so as to hold the watercraft against further tilting. In addition, the chines 35 and 37 at this side of the watercraft tend to trap the water and to assist in the turning. On the opposite side of the watercraft, however, the underside of the boat actually leaves contact with the water. However, there is good stability due to the large contact area between the chines 35 and 37 and the water and the resulting forces obtained thereby. Again, the fore and aft hydrodynamic forces are indicated at FIG. 11.

FIGS. 10 and 11 still further show how the center of buoyancy shifts from the normal point $B_0$ to the point $B_1$ during a slide turn, which point is farther forward from the center of gravity $G_1$ by the distance $l_1$ than the normal distance $l_0$ from the normal center of gravity $G_0$. However, during the edging turn, the center of buoyance moves much closer due to the rearward shifting of the rider's weight to the distance $l_1$ ($G_2$ to $B_z$) versus the normal straight ahead distance $l_0 = G_0 - B_0$.

It should be readily apparent from the foregoing description that the described watercraft hull configuration provides very good handling under all types of conditions and further permits the operator to control the type of turns through shifting of his weight on the watercraft, thus further adding to the rider's enjoyment. Although an embodiment of the invention has been illustrated and described, various changes and modifications may be made without departing from the spirit and scope of the invention, as defined by the appended claims.

I claim:

1. In a planing hull for a small watercraft having an upper deck with a rearwardly positioned seat configured to accomodate a single rider seated in straddle position thereon, said hull being configured for facilitating stability under turning and reducing resistance upon straight ahead running when planing, said hull being formed with an underside having a first horizontally extending uninterrupted area that is normally submerged in a straight ahead planing running condition, a pair of upwardly inclined uninterrupted second portions each extending directly from a respective side of said first portion and terminating at the outer sides of said hull in a first pair of longitudinally extending generally horizontally extending chines for assisting in running stability at the outer edges of said second portions and a pair of third portions angularly disposed relative to said second portion and in close proximity to said second portion and each disposed outwardly of said second portion on respective opposite sides thereof at the side edges of said hull and adpated to become submerged in the body of water upon either or both of turning or side leaning of the rider seated upon said seat for increasing the stability of the watercraft during turning, and a second pair of chines disposed transversely outwardly of said third portions and having a generally straight portion at their outer periphery, said second pair of chines extending in a substantially horizontal direction and terminating at the outer periphery of said hull.

2. In a hull for a small watercraft as set forth in claim 1 wherein the first pair of chines further have a curved portion forwardly of their straight portion, said curved portions being out of the water when the watercraft is traveling at a high speed in a straight ahead direction and in a planing condition and submerged in the body of water upon either or both of turning or side leaning of the rider.

3. In a hull for a small watercraft as set forth in claim 2 wherein the second pair of chines terminates in a pair of forwardly extending curved portions that extend to the bow of the watercraft.

* * * * *